United States Patent [19]

Kinoshita et al.

[11] Patent Number: 4,801,956

[45] Date of Patent: Jan. 31, 1989

[54] IMAGE RECORDING SYSTEM

[75] Inventors: Takao Kinoshita, Tokyo; Masaya Maeda, Yokohama, both of Japan

[73] Assignee: Canon Kabushiki Kaisha, Tokyo, Japan

[21] Appl. No.: 60,861

[22] Filed: Jun. 12, 1987

[30] Foreign Application Priority Data

Jun. 19, 1986 [JP] Japan ..... 61-143882
Jun. 19, 1986 [JP] Japan ..... 61-143883

[51] Int. Cl.[4] ..... G03G 5/00; G03G 5/12
[52] U.S. Cl. ..... 354/3
[58] Field of Search ..... 354/3, 275; 250/315.3; 358/347; 351/78 R

[56] References Cited

U.S. PATENT DOCUMENTS

| | | | |
|---|---|---|---|
| 2,547,473 | 4/1968 | Corcoran | 358/347 |
| 3,379,108 | 4/1968 | Beyer et al. | 352/78 R |
| 3,384,900 | 5/1968 | Buschmann | 358/347 X |
| 3,472,949 | 10/1969 | Banning, Jr. et al. | 358/347 |
| 3,680,955 | 8/1972 | Yata et al. | 354/3 X |
| 3,825,675 | 7/1974 | Bradford et al. | 358/347 |
| 3,854,804 | 12/1974 | McMaster | 354/275 X |
| 3,972,716 | 8/1976 | Pressman | 354/3 X |
| 4,007,889 | 2/1977 | Langford | 352/78 R X |
| 4,175,719 | 11/1979 | Sperkman et al. | 352/78 R X |
| 4,249,106 | 2/1981 | Maruyama et al. | 250/315.3 X |

*Primary Examiner*—W. B. Perkey
*Attorney, Agent, or Firm*—Fitzpatrick, Cella, Harper & Scinto

[57] ABSTRACT

An image recording system capable of storing images at high density wherein a photoelectric conversion member, which converts an optical image into electric image information, is formed in a film configuration, optical images are incident to a plurality of different regions on the photoelectric conversion member through an optical low-pass filter and a color separation filter to store a plurality of color images, the photoelectric conversion member is made to contact the optical low-pass filter, and a scan unit is provided for scanning an electron beam to the photoelectric conversion member.

12 Claims, 10 Drawing Sheets

IMAGE RECORDING SYSTEM

BACKGROUND OF THE INVENTION

Field of the Invention

The present invention relates to a novel image recording system.

Related Background Art

In conventional image recording systems there are known for example a method of recording a plurality of images on a silver salt film, and a method of forming latent images on a photosensitive member with electrophotographic techniques to obtain real images using toner.

With such conventional methods, there are however some problems; in the case of using silver salt film, it is difficult to develop photographed images instantly. Even if instant photography is employed, there arises a problem that a plurality of images must be taken using as many films as the number of images.

In the case of using electrophotography technique, the apparatus required for obtaining eventual real images becomes bulky and it is not practical in regard to portability.

There is known another method, as disclosed for example in Japanese Patent Laid-Open Gazette No. 94875/1975. According to this method, energy is irradiated upon a high resistance layer formed on a conductive material to obtain a low resistance energy-irradiated area at least smaller by one digit than that of an area not irradiated. Such a medium storing image information in the form of resistance distribution is mounted adjacent a target plane of a tube containing an electron gun. After evacuating the tube, the medium is scanned by an electron beam emitted from the electron gun to read the image information stored in the medium. With such a construction, however, a portable camera practically usable cannot be realized.

There is also known an apparatus as disclosed in Japanese Patent Laid-Open Gazette No. 29915/1979. With this apparatus, the image information of an original is recorded on the surface of a photosensitive member as an electrostatic latent image. The electrostatic latent image is scanned with an electron beam to generate secondary electrons which in turn are amplified to output a time sequential signal. In this case also, the apparatus becomes bulky and a smooth recording or reproduction associated with the photosensitive member is not possible.

SUMMARY OF THE INVENTION

It is an object of the present invention to provide an image recording system capable of eliminating the above prior art problems.

It is another object of the present invention to provide an image recording and/or reproduction system which is compact and capable of recording and/or reproducing high density images.

It is another object of the present invention to provide a cartridge containing a medium which is suitable for use with the image recording and/or reproduction system as above.

To achieve the above objects, an embodiment of the image recording system of this invention is constructed such that a photoelectric conversion member, which converts an optical image into electric image information, if formed in a film configuration, optical images are incident to a plurality of different regions on said photoelectric conversion members through an optical low-pass filter and a color separation filter to store a plurality of color images, and said photoelectric conversion member and said optical low-pass filter are tightly contacted.

Therefore, it is possible to realize an image recording system capable of recording and reproducing color images with simple construction.

Another embodiment of an image recording system of this invention is constructed such that there are provided a cartridge containing a photoelectric conversion member in a film configuration for converting optical images into electric image information and pushing means for pushing said photoelectric conversion member against an optical system while said cartridge is loaded in said optical system, wherein an optical image is made to be incident to a predetermined region of said photoelectric conversion member to store said optical image while said photoelectric conversion member is pushed against said optical system.

With the above construction, it is possible to exchange a recording medium at one touch operation and to record optical images with high density.

Another embodiment of the cartridge of this invention which contains a photoelectric conversion member in a film configuration for converting optical images into electric image information is constructed such that the cartridge is provided with a roller housing in which a roller is accommodated for pushing said photoelectric conversion member against an optical system of an image recording system.

Therefore, it is possible to readily push the photoelectric conversion member in the cartridge against the optical system to thereby enable a high density recording.

The other objects and aspects of the present invention will become more apparent by referring to the following description and appended drawings.

DETAILED DESCRIPTION OF THE PREFERRED EMBODIMENTS

The present invention will now be described in detail in connection with the preferred embodiments.

Figure 1:
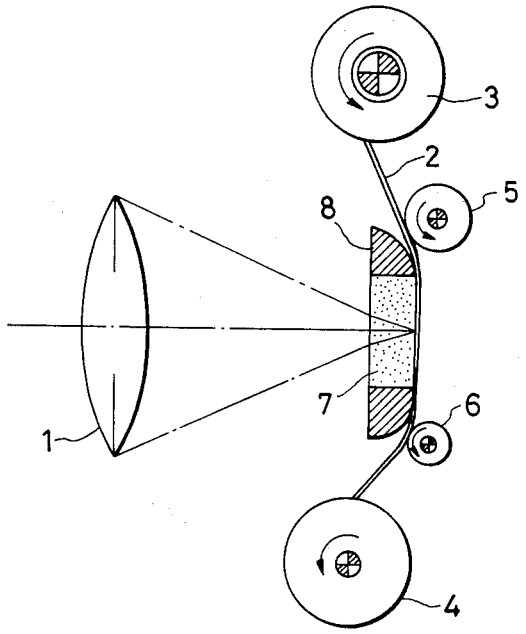
FIG. 1 is a schematic diagram showing the main part of an image recording system according to the present invention.

Referring to FIG. 1, showing a first embodiment of this invention, the image recording apparatus comprises an optical system 1 having a diaphragm, a photosensitive member 2 or film, a supply reel 3, a take-up reel 4, conductive guide rollers 5 and 6, a crystal low-pass filter 7, and a conductive holder 8. The photosensitive member is supplied from the supply reel to the take-up reel. Light from an image is incident on the photosensitive member between the guide rollers via the optical system 1 and the crystal low-pass filter 7 and the light-borne stored therein. The low-pass filter 7 also serves to maintain an evenness of the film 2.

The photosensitive member or film 2 is formed by depositing on a base film a flexible thin film having a photosensitive characteristic to be described later.

Figure 2A:
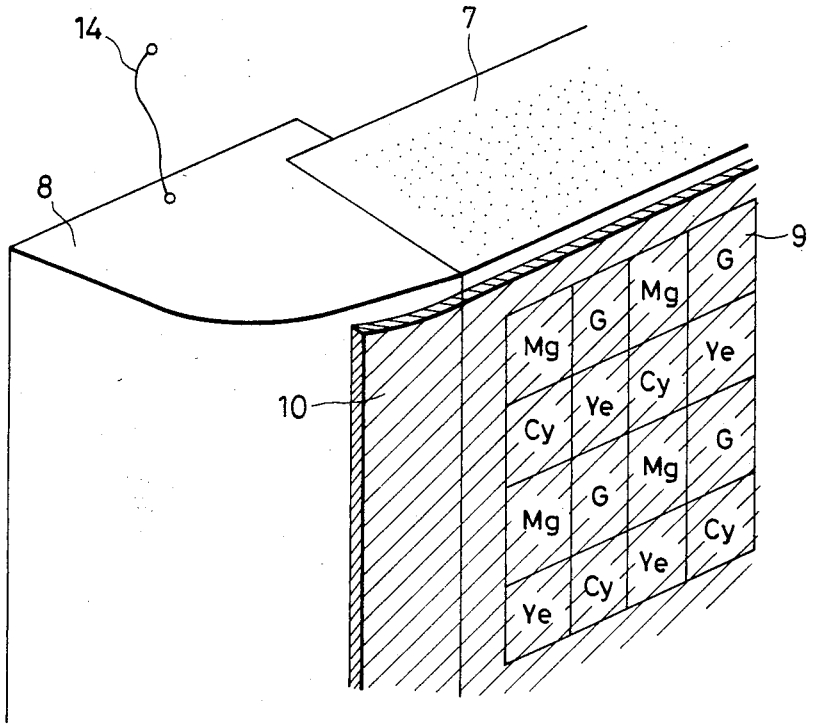
FIG. 2A is a perspective view showing an example of a low-pass filter.

A mosaic color filter 9 as shown in FIG. 2A is mounted on the surface of the low-pass filter where the film contacts. The mosaic color filter 9 is composed of magenta (Ma), green (G), cyan (Cy), and yellow (Ye) filters, the magenta and green filters being disposed repetitively in this order in one row while in adjacent rows the cyan and yellow filters are disposed. The pattern and combination of filters in each row are not, however, limited thereto. A transparent electrode 10 is formed on the surface of the color filter 9.

A portion of the transparent electrode 10 contacts the holder 8 from which one lead wire 14 is extended.

Figure 2B:
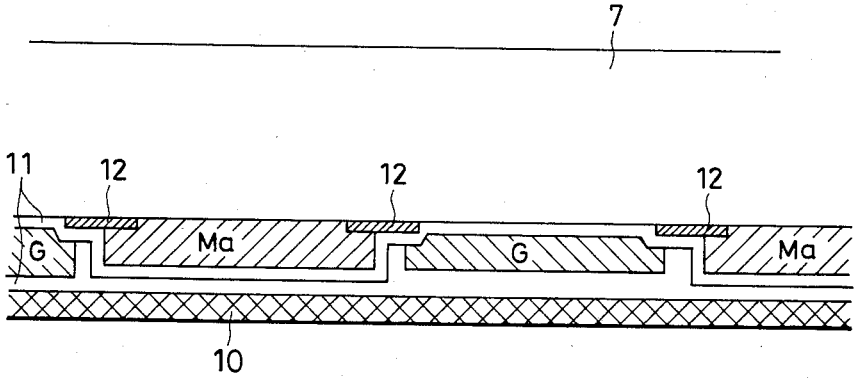
FIG. 2B is a sectional view of the low-pass filter.

FIG. 2B shows a sectional view of the low-pass filter. An example of forming a color filter on the surface of the low-pass filter is as follows: first magenta filters are formed on the low-pass filter. After covering the magenta filters with a transparent protective film 11, green filters are formed intermediately of the magenta filters to thereafter form another transparent protective film 11. Lastly, the transparent electrode 10 described above is formed.

The protective film 11 may use epoxy resin or sputtered silicon dioxide. The transparent electrode 10 may use polysilicon which prevents possible abrasion of the color filter contacting the film, information in the photosensitive member being read through the transparent electrode 10. Reference number 12 denotes a light shielding film.

Figure 3:
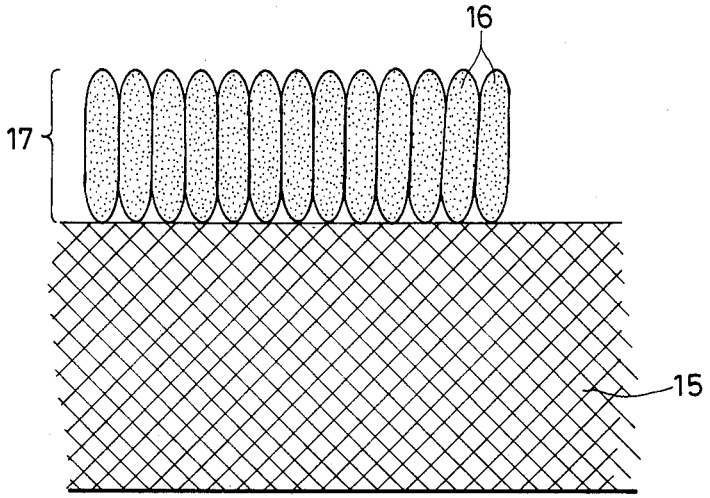
FIG. 3 shows an example of the construction of a photoelectric conversion member in a film configuration.

FIG. 3 is a sectional view of the photosensitive member or film 2. The base film 15 is conductive and made of, for example, a metal sheet such as aluminum foil. A photoconductive layer 17 with oriented capillary crystals is formed on the surface of the film 2. Such material is described, for example, in U.S. Pat. No. 4,363,711 so the detailed description therefor is omitted.

The photosensitive member has a characteristic that its resistance in the thickness direction decreases as incident light increases, whereas its resistance in the direction parallel to the plane is extremely high.

Figure 4:
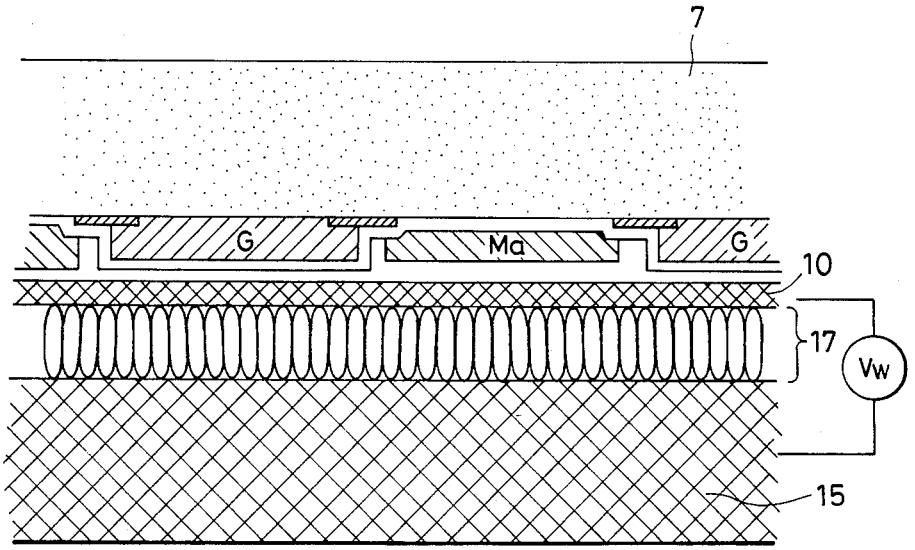
FIG. 4 is a sectional view of the low-pass filter and the film tightly contacted.

FIG. 4 shows the photosensitive member 2 and the low-pass filter 7 contacting the former. A preset bias $V_w$ is applied between the transparent electrode 10 and the base 15.

If a bias $+V_1$ is applied, the resistance of the capillary crystals decreases in dependence on the incident light amount. In other words, the time while the bias $+V_1$ is applied corresponds to an exposure time.

On the other hand, if an inverse bias $-V_1$ is applied, the resistance of the capillary crystals increase to cancel the resistance change caused by the $+V_1$ and reset the stored information.

The pattern information due to the resistance change is maintained if the inverse bias is not applied.

Figure 5:
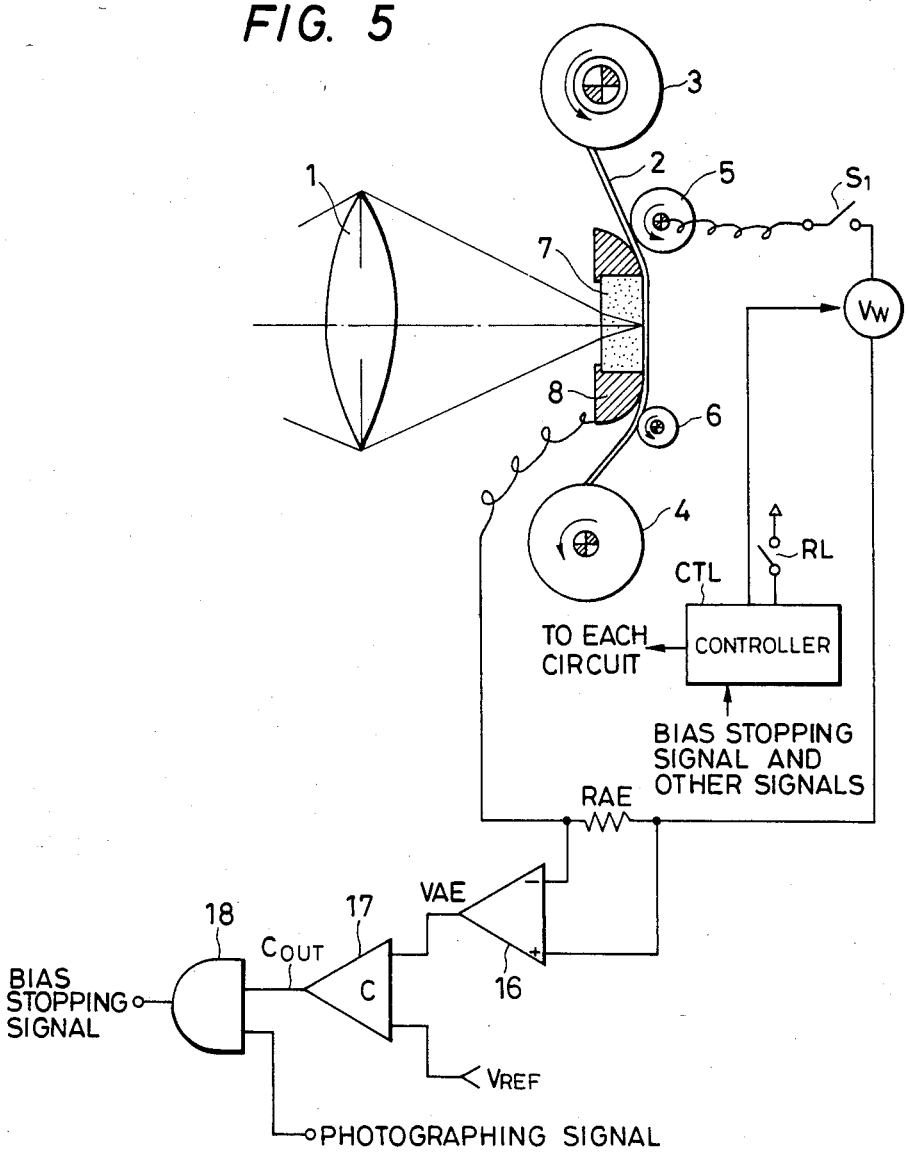
FIG. 5 schematically illustrates an example of a control system for an image storage amount of the image recording system.

In the image recording construction shown in FIG. 5, there are used a bias switch $S_1$, a bias supply $V_w$, a load resistor $R_{AE}$, an amplifier 16, a comparator 17, an AND gate 18, a release switch RL and a controller CTL.

Figure 6:
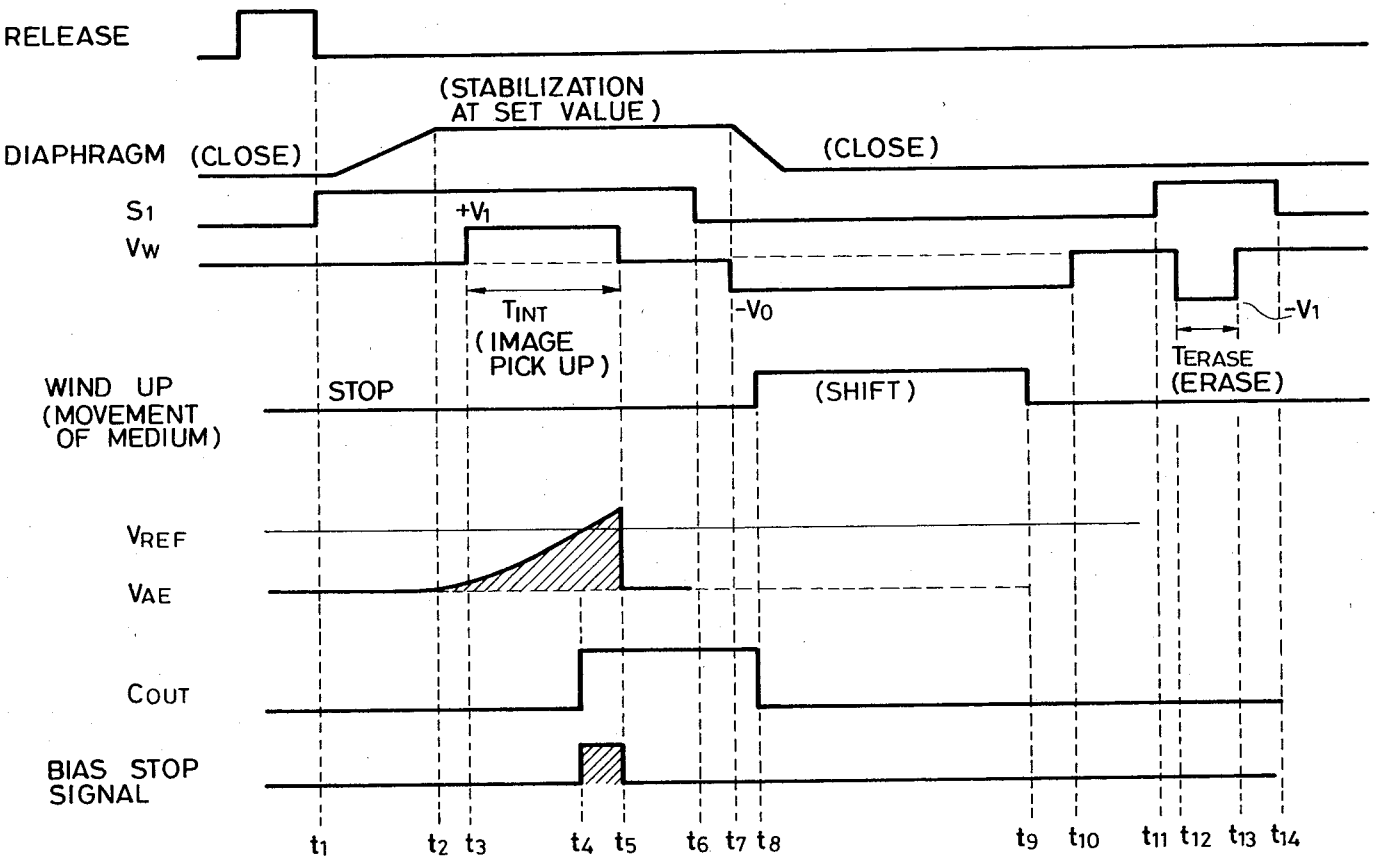
FIG. 6 is a timing chart illustrating the operation of the control system.

FIG. 6 is a timing chart illustrating the recording operation. Image photographing starts when a release signal is outputted upon actuation of the release switch RL. When the switch $S_1$is closed at time $t_1$, the diaphragm is driven to obtain a preset value. The diaphragm becomes stable at time $t_2$ and after a certain time lapse, $+V_1$ of the bias supply $V_w$ is applied at time $t_3$ to start storing information.

Thus, a resistance distribution pattern corresponding to the optical image is formed on the film 2. The current amount passing to the resistor $R_{AE}$ from the bias supply $V_w$, switch $S_1$, roller 5, film 2 and holder 8 changes in accordance with the resistance distribution pattern. The voltage across the resistor $R_{AE}$ is amplified by the amplifier 16 and compared with a reference voltage $V_{REF}$ at the comparator 17 to output a high level signal Cout when excessing the reference voltage $V_{REF}$, as shown in FIG. 6. The signal Cout and a photographing signal (i.e., a signal indicative of $V_w = +V_1$) are supplied to the AND gate 18 to produce a bias stop signal at time $t_4$ as shown in FIG. 6.

After a short time lag after the bias stop signal is outputted, the bias $V_w$ is made 0 at time $t_5$. Thus, image information has been stored at a proper level.

Thereafter, the switch $S_1$ is opened at time $t_6$. The bias $V_w$ at slightly negative value of $-V_0$ is applied at time $t_7$ to electrostatically separate the film from the face plate and start closing the diaphragm.

The take-up reel winds up the film by one frame during time $t_8$ to $t_9$. The bias $V_w$ is set again at 0 at time $t_{10}$. While the switch $S_1$ is closed during time $t_{11}$ to $t_{14}$, the bias $V_w$ at an inverse bias voltage $-V_1$ is applied during time $t_{12}$ to $t_{13}$ to erase any information in a new frame and prepare a next recording.

Figure 7:
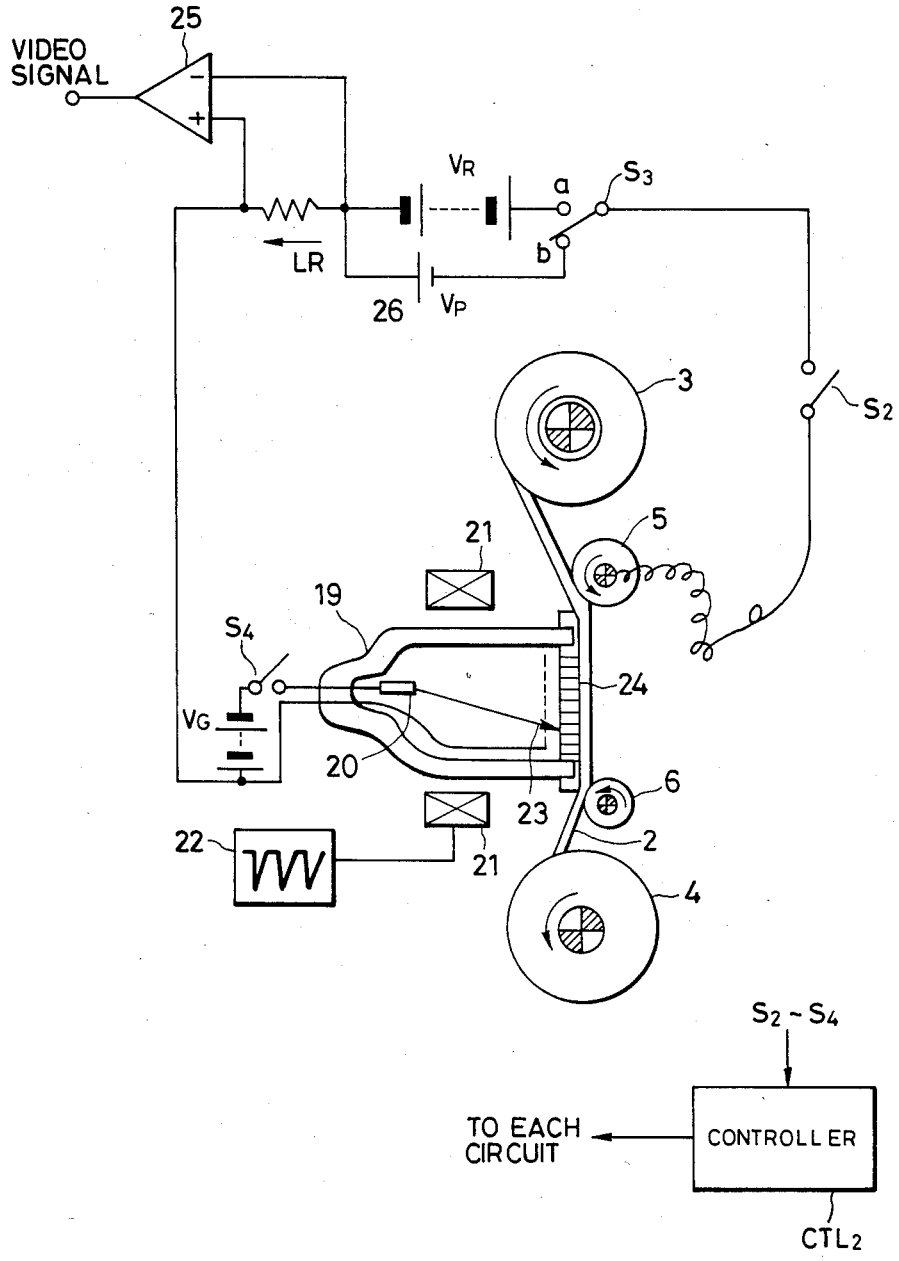
FIG. 7 schematically shows an example of the construction of a reproduction apparatus using a photoelectric conversion member of the image recording system.

In the reproduction apparatus whose construction is shown in FIG. 7, there are used switches $S_2$ to $S_4$, a vacuum envelope 19, an electron gun 20, a deflection yoke 21, a driver circuit 22 for supplying a deflection signal to the deflection yoke, a grid 23, a face plate 24, an amplifier 25, a resistor 26, a read voltage supply $V_R$ and a thermoelectron acceleration voltage supply $V_G$. Similarly to the photoconductive layer 17, the phase plate 24 is composed of a number of capillary crystals oriented in the thickness direction. The resistance in the thickness direction is relatively low whereas the resistance in the direction alone the plane is extremely high.

Figure 8:
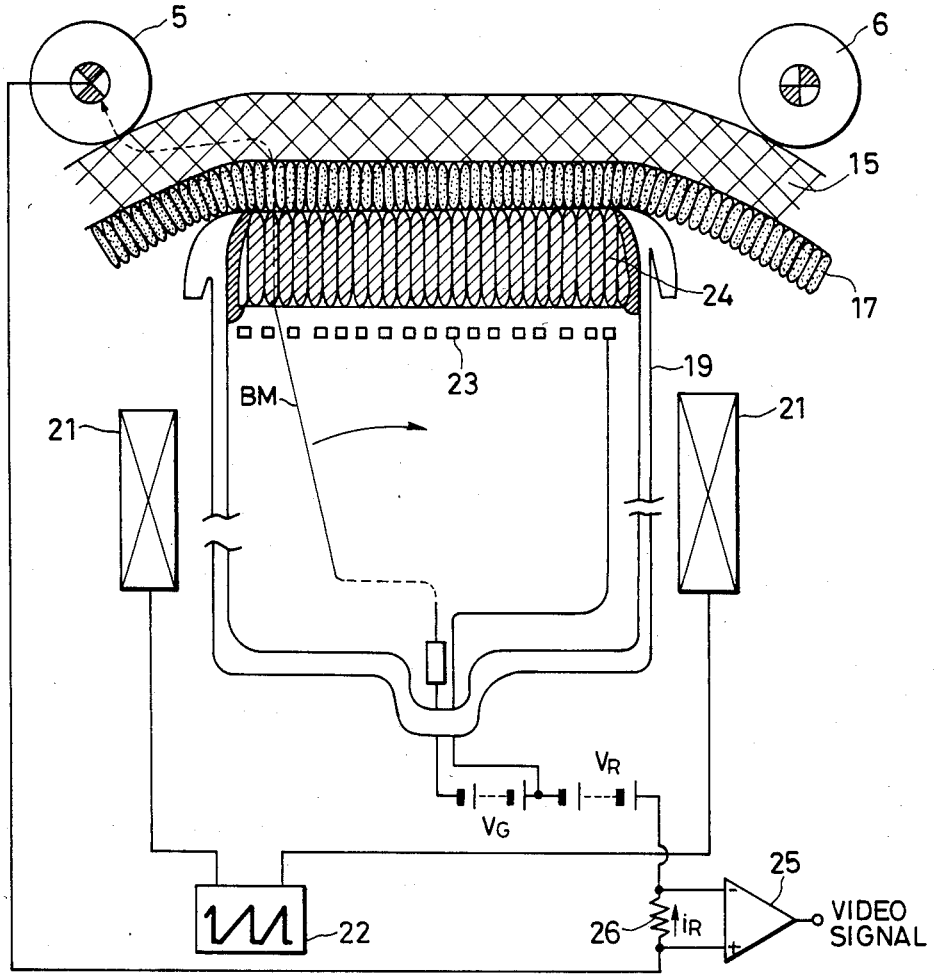
FIG. 8 illustrates the film and the vacuum envelope both tightly contacted.

FIG. 8 is an enlarged view of the main portion of FIG. 7. The construction of the reproduction apparatus shown in FIGS. 7 and 8 will be described.

An image of the film 4 recorded by the recording apparatus is sequentially scanned at a standard television period by a beam deflected by the driver circuit 22, with $V_G$ and $V_R$ being applied as shown in FIG. 7.

Since the resistance of the face plate in the thickness direction is low, the beam impinging the face plate is passed to the outside of the vacuum envelope 19 and flows via the photoconductive layer 17, base film 15, roller 5, resistor 26 to the voltage supply $V_R$.

The surface resistance distribution pattern of the photoconductive layer 17 corresponds to the recorded image pattern so that the current flowing through the resistor 26 changes in accordance with the recorded image pattern. Thus, the information in the photoconductive layer 17 can be time-sequentially read after amplifying the voltage across the resistor 26 by the amplifier 25. In the figure, CTL 2 denotes a controller.

Figure 9:
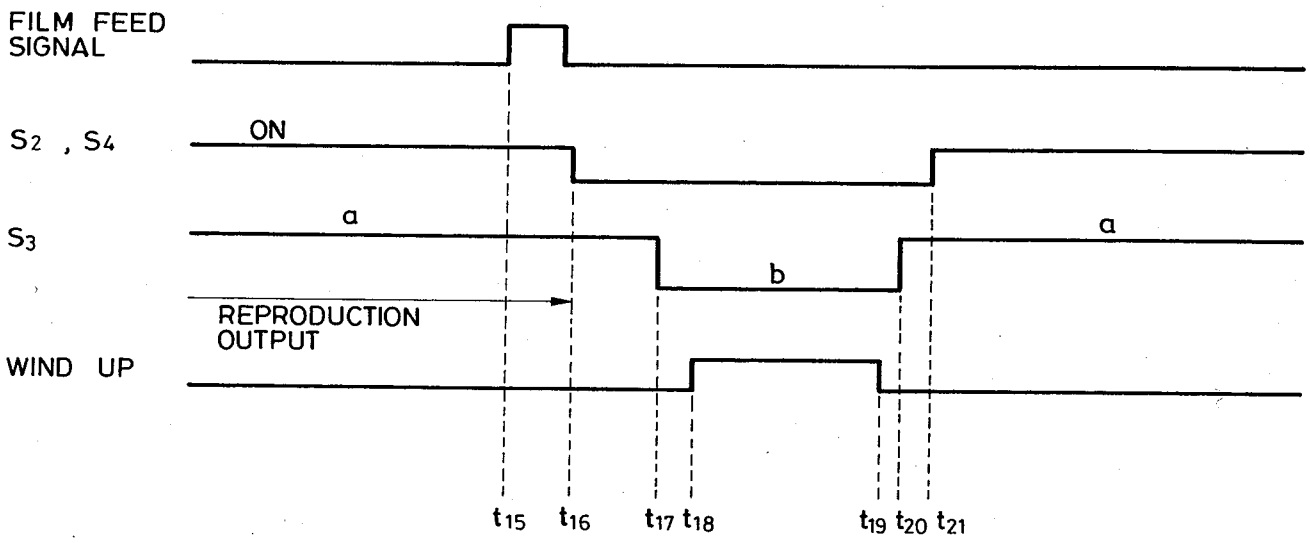
FIG. 9 is a timing chart illustrating the reproduction operation.

FIG. 9 is a timing chart illustrating the timings of film feeding and the switch timings of the voltage supplies.

After a film feed signal is outputted at time $t_{15}$ from the controller CTL 2 to read the next frame of the film, the switches $S_2$ and $S_3$ are turned off at time $t_{16}$ to stop the reproduction operation having been continued up to that time. Thereafter, the switch $S_3$ is connected to the b side at time $t_{17}$ to set the VR voltage at slightly negative value of $V_p$. As a result, the film is electrostatically separated from the face plate in the similar manner as during the recording to avoid the friction between the film and the face plate and reduce a winding load. Thereafter, during time $t_{18}$ to $t_{19}$, the take-up reel 4 feeds the film by one frame to prepare a next image reading.

The switch $S_3$ is again connected to the side a at time $t_{20}$, and the switches $S_2$ and $S_4$ are turned off to start reading the next frame.

Figure 10:
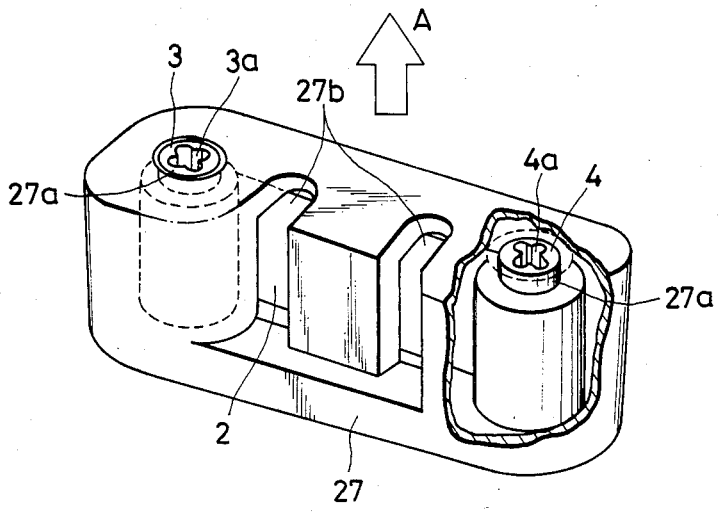
FIG. 10 is a perspective view showing an example of a cartridge.

FIG. 10 shows the construction of a cartridge containing a film 2, a supply reel 3, a take-up reel 4 and so on. A film 2 is wound between the supply and take-up reels 3 and 4. A protrusion of cylindrical shape is formed extending from the top end of each reel, the protrusion being inserted into an opening 27*a* to rotatably support the reel. There are also formed two recesses 27*b* in the cartridge 27 into which the guide rollers 5 and 6 are fitted. The protrusion of each reel is formed with an engaging hole 3*a*, 4*b* having plural notches for the purpose of loading the cartridge into a camera by moving the former in the A direction toward the latter.

Figure 11:
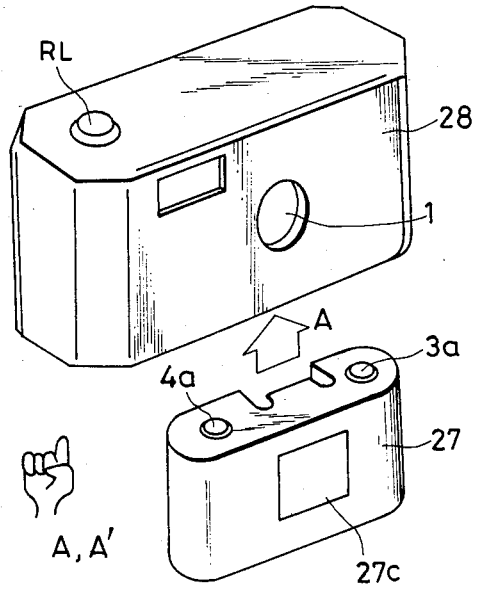
FIG. 11 illustrates in what direction a cartridge is loaded in a camera.

FIG. 11 illustrates in what direction the cartridge 27 is loaded in the camera main body 28. In the figure, reference RL denotes a release switch, 27*c* denotes a window from which light is incident via the optical system 1 to a film 2 of the cartridge loaded in the camera.

Figure 12A:
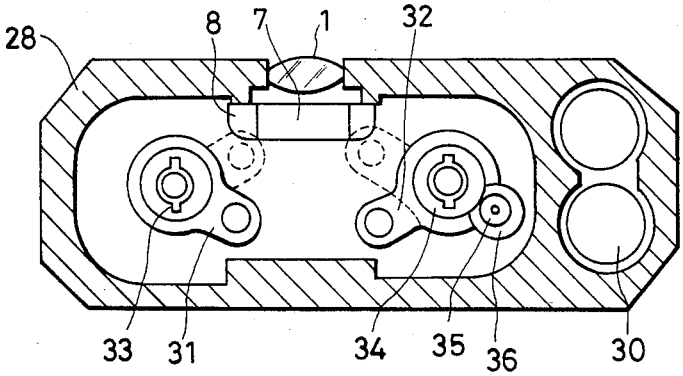
FIGS. 12A and 12B are top and bottom views for a camera body.
Figure 12B:
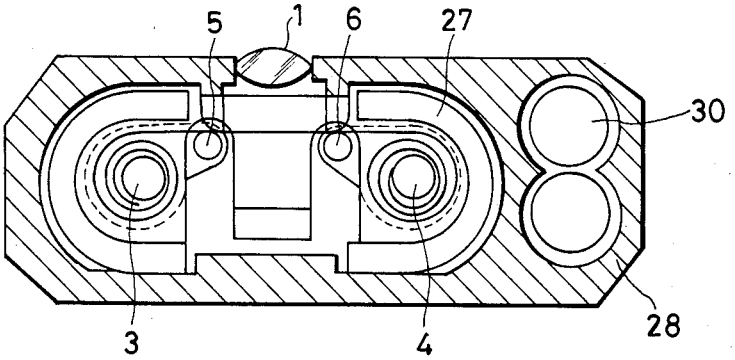

FIGS. 12A and 12B are top and bottom views illustrating how the cartridge is loaded in the camera main body 28, wherein FIG. 12A shows an unloaded state and FIG. 12B shows a loaded state. Reference number 30 denotes a battery.

Guide levers 31 and 32 are retracted as shown in FIG. 12A when a cartridge is not still loaded in the camera, and are moved to the positions indicated by broken lines in FIGS. 12A and 12B by a drive mechanism (not shown) when a cartridge is loaded in the camera.

The guide rollers 5 and 6 are rotatably mounted at the ends of the levers 31 and 32, respectively. The guide levers 31 and 32 are electrically isolated from the rollers 5 and 6.

A take-up spindle 33 and a supply spindle 34 or cylindrical shape each having plural notches are formed in the camera main body having an equal distance therebetween to that between the reels. The supply spindle has a mechanism for giving back-tension, known in the field of tape recorders and the like. The take-up spindle is constructed such that a winding force is given from a take-up motor 36.

Engagement between the spindles and the reels is constructed in a similar manner to that used by a cassette of a VTR or the like.

Figure 13:
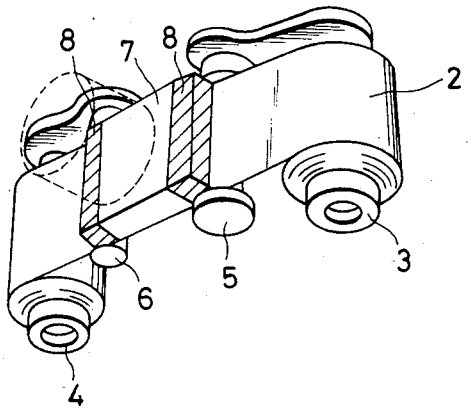
FIG. 13 illustrates a film and a low-pass filter both tightly contacted.

FIG. 13 shows a film 2 pushed against the low-pass filter 7. The film 2 is pushed against the low-pass filter 7 at proper pressure with the guide rollers 5 and 6. The film is drawn from the supply reel while being guided within a width defined by flange portions formed on both sides of the guide roller 5, and fed to the guide roller 6. With the aid of the rollers as well as the above-described back-tension, the film maintains its evenness at the exposure position.

What we claim is:

1. An image recording system comprising:

a photoelectric conversion member formed in a film configuration for converting an optical image into photoelectric image information;

a filter plate which includes a transparent electrode;

a color separation filter; and control means for applying a predetermined first bias voltage between said photoelectric conversion member and said filter plate during image recording, and then applying a second bias voltage whose polarity is opposite to that of said first bias voltage, between said photoelectric conversion member and said filter plate before transfer of said photoelectric conversion member, wherein optical images are incident on a plurality of different regions on said photoelectric conversion member through said filter plate and said color separation filter to store a plurality of color images, and said photoelectric conversion member formed in a film configuration is made to contact said filter plate at least for the purpose of image recording.

2. An image recording system according to claim 1, wherein said system also has an image reproduction capability and further comprises scan means for scanning an electron beam upon said photoelectric conversion member.

3. An image recording system according to claim 2, wherein a conductor is formed in said scan means at the plane contacting said photoelectric conversion member, said conductor having different conductivities in the directions along its thickness and in said plane, respectively.

4. An image recording system according to claim 1, wherein said transparent electrode of said filter plate is formed at the plane contacting said photoelectric conversion member.

5. An image recording system according to claim 4, wherein said color separation filter is formed between said filter plate and said transparent electrode.

6. An image recording system according to claim 5, wherein said color separation filter has a plurality of color filters disposed in a predetermined repetitive pattern.

7. An image recording and reproduction system comprising:

(a) means for feeding a photosensitive member in a film configuration;

(b) recording control means for storing an image obtained through an optical system in said photosensitive member as electric image information, while contacting said photosensitive member fed by said feeding means to an optical member including a transparent electrode; and control means for applying a predetermined first bias voltage between said photosensitive member and said optical system during image recording, and then applying a second bias voltage, whose polarity is opposite to that of said first bias voltage, between said photosensitive member and said optical system before transfer of said photosensitive member.

8. An image recording and reproduction system according to claim 7, further comprising reproduction means for reproducing the electric image information stored in said photosensitive member by scanning said photosensitive member with an electron beam.

9. An image recording and reproduction system according to claim 7, wherein said optical member is of a plane shape at least where said optical member contacts said photosensitive member.

10. An image recording and reproduction system according to claim 7, wherein said optical member includes a color separation filter.

11. An image recording and reproduction system according to claim 7 wherein said optical member includes an optical low-pass filter.

12. An image recording and/or reproduction system according to claim 7, wherein said bias means supplies an electric bias to said photosensitive member via said transparent electrode of said optical member.

* * * * *